US005735051A

United States Patent [19]

Berns

[11] Patent Number: 5,735,051

[45] Date of Patent: Apr. 7, 1998

[54] KNIFE WITH REPLACEABLE BLADE

[75] Inventor: Harald Berns, Wuppertal, Germany

[73] Assignee: Michael Schlipkoter, Solingen, Germany

[21] Appl. No.: 780,376

[22] Filed: Jan. 8, 1997

[30] Foreign Application Priority Data

Jan. 9, 1996 [DE] Germany ..... 196 00 47.0

[51] Int. Cl.[6] ..... B26B 3/08

[52] U.S. Cl. ..... 30/333; 30/329

[58] Field of Search ..... 30/329, 330, 332, 30/333, 335, 336, 337, 338, 339, 151, 162

[56] References Cited

U.S. PATENT DOCUMENTS

| | | | |
|---|---|---|---|
| 1,768,604 | 7/1930 | Hurd | 30/332 |
| 3,078,572 | 2/1963 | Everton | 30/333 |
| 3,171,201 | 3/1965 | Carifi | 30/162 |
| 4,240,202 | 12/1980 | Gilbert | 30/162 |
| 4,389,776 | 6/1983 | Okada | 30/162 |

FOREIGN PATENT DOCUMENTS

| | | |
|---|---|---|
| 2839067 | 3/1979 | Germany . |
| 4421351 | 2/1995 | Germany . |

*Primary Examiner*—Hwei-Siu Payer
*Attorney, Agent, or Firm*—Herbert Dubno; Andrew Wilford

[57] ABSTRACT

A utility knife for use with a flat blade having a pair of opposite faces has an elongated base part formed with an outwardly directed rear support surface, an outwardly directed front support surface separated longitudinally therefrom, and an inwardly directed intermediate surface between the support surfaces. The blade normally lies on the front support surface and projects longitudinally forward past the base part. An elongated cover part has an inwardly directed rear surface normally riding on the base-part rear support surface, an inwardly directed front surface normally pressing the blade inward against the base-part front support surface, and an outwardly directed intermediate surface. The cover part is displaceable longitudinally between one longitudinal end position with the intermediate surfaces transversely confronting each other and another longitudinal end position with the intermediate surfaces transversely out of alignment with each other. A biasing formation on at least one of the parts in the one longitudinal end position urges the cover-part intermediate surface transversely outward with a spring force into engagement with the base-part intermediate surface and thereby presses the front and rear cover-part surfaces toward the respective front and rear base-part surfaces.

20 Claims, 7 Drawing Sheets

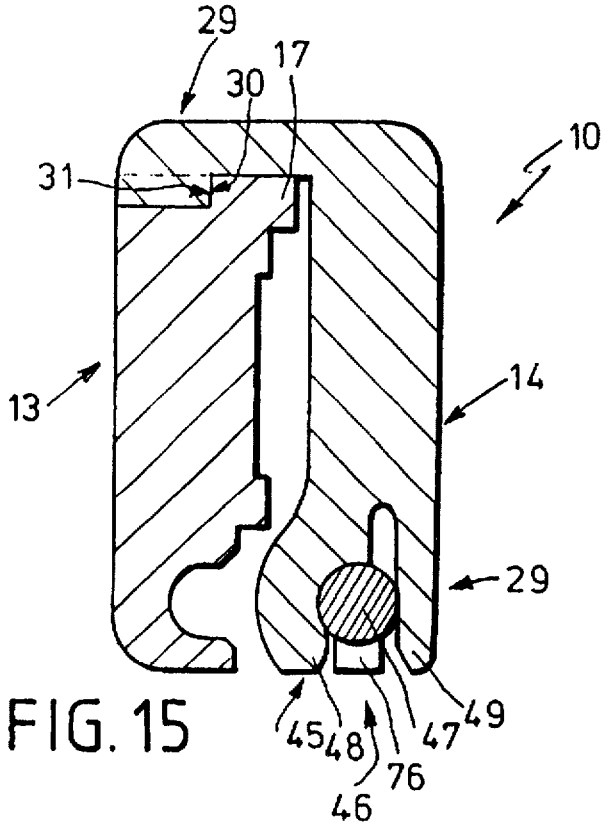
FIG. 15
FIG. 17
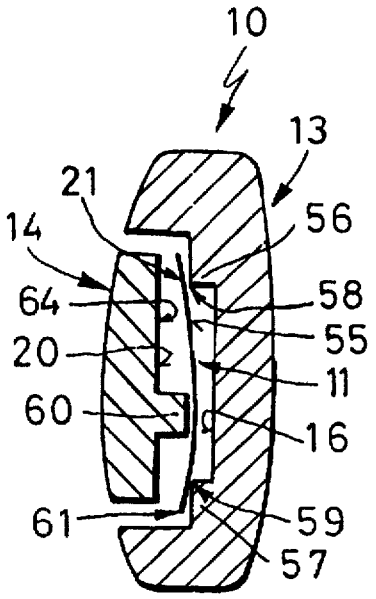
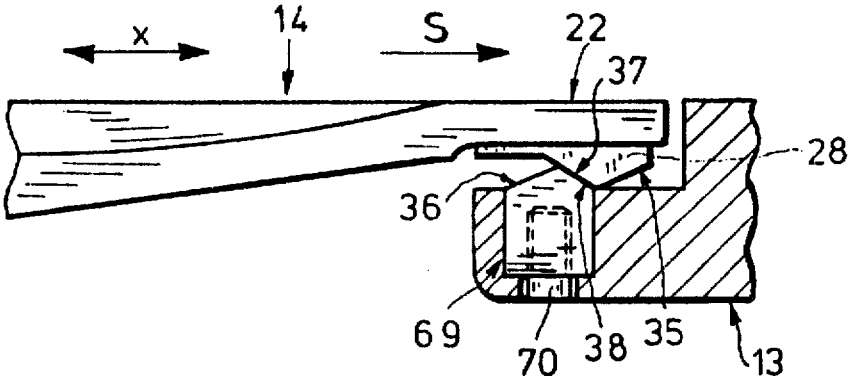
FIG. 16

KNIFE WITH REPLACEABLE BLADE

FIELD OF THE INVENTION

The present invention relates to a knife. More particularly this invention concerns a utility knife with a replaceable blade.

BACKGROUND OF THE INVENTION

A standard utility knife has a base part adapted to be held in the hand and formed with a seat on which flatly sits a disposable trapezoidal blade. According to German patent document 2,839,067 (U.S. equivalent Pat. No. 4,140,202) a cover part is engageable over the blade to retain it solidly in position on the base part. This cover can be pivoted to the side when the blade needs to be extended or the end of a snap-off blade must be removed and the blade advanced. The cover part can be slid forward to lock it in place and a thumb screw secures the two parts relative to each other in the front position. In German patent document 4,421,351 the cover part can pivot to the side and is held in place by a separate latch.

While this type of utility knife is relatively effective, holding the blade solidly enough that it can even withstand the forces in, for instance, carpet laying, it is fairly complex and slightly difficult to use. It takes two hands to change the blade, and the thumb screw can get lost.

OBJECTS OF THE INVENTION

It is therefore an object of the present invention to provide an improved utility knife suitable for carpet work.

Another object is the provision of such an improved utility knife suitable for carpet work which overcomes the above-given disadvantages, that is which is relatively simple in construction, which holds the blade very solidly, and whose blade is very easy to change.

SUMMARY OF THE INVENTION

A utility knife for use with a flat blade having a pair of opposite faces has according to the invention an elongated base part formed with an outwardly directed rear support surface, an outwardly directed front support surface separated longitudinally therefrom, and an inwardly directed intermediate surface between the support surfaces. The blade normally lies on the front support surface and projects longitudinally forward past the base part. An elongated cover part has an inwardly directed rear surface normally riding on the base-part rear support surface, an inwardly directed front surface normally pressing the blade inward against the base-part front support surface, and an outwardly directed intermediate surface. The cover part is displaceable longitudinally between one longitudinal end position with the intermediate surfaces transversely confronting each other and another longitudinal end position with the intermediate surfaces transversely out of alignment with each other. A biasing formation on at least one of the parts in the one longitudinal end position urges the cover-part intermediate surface transversely outward with a spring force into engagement with the base-part intermediate surface and thereby presses the front and rear cover-part surfaces toward the respective front and rear base-part surfaces.

Thus with this system the cover part is displaced longitudinally into the one end position while the biasing formation is actuated to lock the cover part and blade in place. When moved to the other end position the cover part can be separated transversely from the base part because the intermediate surfaces are out of each other's way, and the cover part can be lifted to replace or move the blade.

According to the invention the biasing formation is an elastically flexible body of the cover part which to this end is made of a flexible plastic such as POM or PA reinforced with glass fibers. It can also be a spring element mounted on the base part and transversely bearing on the cover part. The base part can be made of a stiff synthetic resin or a metal such as aluminum.

The knife can also have in accordance with this invention holding formations on the parts for releasably retaining the cover part in the one longitudinal end position on the base part. These holding formations can include a transversely projecting bump on one of the intermediate surfaces and a transversely oppositely open recess on the other intermediate surface complementarily engageable with the bump in the one longitudinal end position. The holding formations can also be constituted in part by the spring, in that the spring element is formed with a bump constituting one of the holding formations. The cover part in this case is formed with a recess complementarily engageable with the bump and forming another of the holding formations.

The rear surfaces according to the invention can both be substantially planar and parallel to a longitudinal axis of the cover part. They cans also both be substantially planar and form a small forwardly open acute angle with a longitudinal axis of the cover part. In another arrangement one of the rear surfaces is formed with a transverse projection extending toward the other of the rear surfaces and the other of the rear surfaces is formed with a cutout fitting complementary with the projection in the one longitudinal end position.

The cover part in accordance with the present invention is formed with a pair of inwardly projecting arms that flank the base part and are each formed with a respective such outwardly directed intermediate surface. The base part having a pair of guides each juxtaposed with a respective one of the arms and each formed with a respective such inwardly directed intermediate surface. The base part is formed with a pair of lateral notches in each of which a respective one of the arms is limitedly longitudinally displaceable. In another arrangement the base part is provided with a longitudinally extending pin in one of the notches and the respective arm is wrapped around the pin and forms therewith a slide-joint and hinge. The cover part is pivotal about the pin on the base part in at least the one longitudinal end position.

To stiffen the blade as much as possible the base-part front surface is formed with a pair of ridges transversely spaced to support only longitudinal edges of the blade. The cover part is formed with a middle ridge engageable between the base-part ridges with the blade so that the blade is bent between the ridges, which action also forms a spring retaining the cover and base parts in the set position. The blade has a longitudinal cutting edge and an opposite back edge and the middle ridge is closer to the cutting edge than to the back edge. In addition to stabilize the blade the front support surface is formed with at least one short outwardly projecting pin engaged through a hole in the blade and the cover part is formed with a longitudinally extending slot in which the pin engages.

For ease of use the cover part is formed with a front thumb recess having a back edge and a rear thumb recess having a front edge. It is formed between the recesses with a full-strength web.

BRIEF DESCRIPTION OF THE DRAWING

The above and other objects, features, and advantages will become more readily apparent from the following description, reference being made to the accompanying drawing in which:

FIG. 15 is a cross section taken along line XV—XV of FIG. 12;

FIG. 16 is a longitudinal section taken along line XVI—XVI of FIG. 13;

FIG. 17 is a cross section taken along line XVII-XVII of FIG. 12; and

SPECIFIC DESCRIPTION

Figure 1:
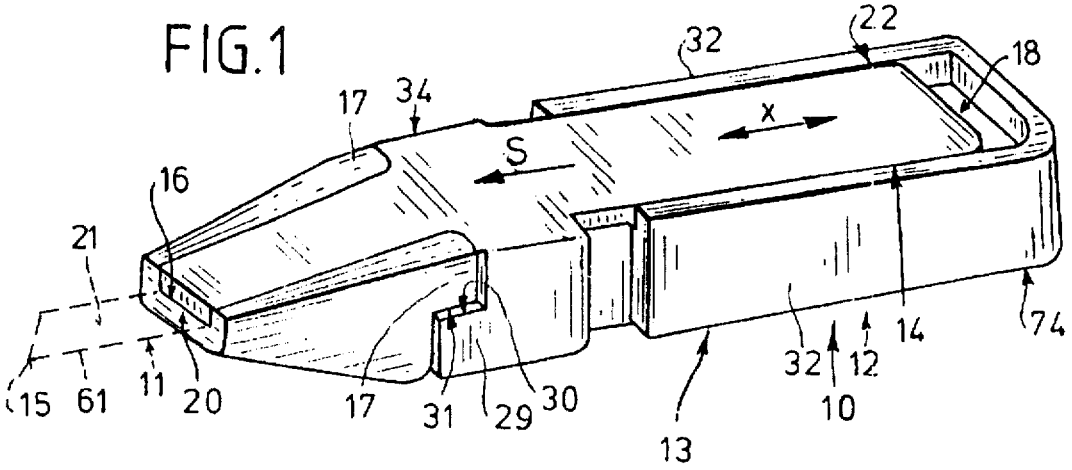
FIG. 1 is a perspective view of the utility knife according to the invention.

As seen in FIGS. 1 through 7, a utility knife 10 according to the invention comprises a body 12 that holds a standard trapezoidal utility blade 11 having an edge 61, a point 15, an upper side 21, and a lower side 55. The knife body 12 has a base part 13 and a cover part 14 that are relatively shiftable along their longitudinal axes as shown by arrow x.

Figure 2:
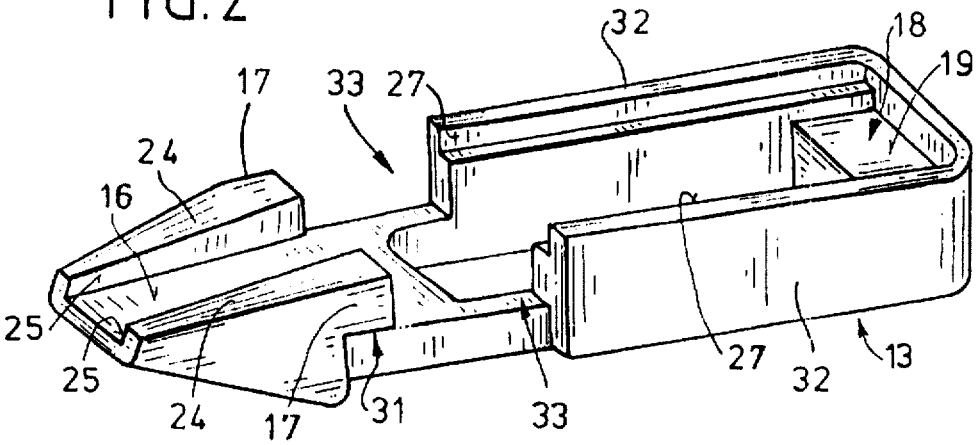
FIGS. 2 and 3 are perspective views of the base and cover of the knife.

The base part 13 as best shown in FIG. 2 has a planar front-end support surface 16 on which the blade 11 sits with its point 15 extending longitudinally forward (to the left in FIGS. 1–7) past the front end of the part 13. The front surface 16 is flanked by a pair of longitudinally extending abutments or guides 17 having rear ends with downwardly directed surfaces 31 extending here parallel to the longitudinal direction x, upper surfaces 24, and inner side surfaces 25 parallel to each other but perpendicular to the surface 16. A rear end of the base part 13 defines a support 18 having a surface 19 extending longitudinally and parallel to the surfaces 16 and 31. The part 13 has rear sides or cheeks 32 that define longitudinally extending surfaces 27 parallel to each other and perpendicular to the plane of the surface 19. The part 13 is further formed between each side 32 and the respective guide 17 with a cutout or notch 33 and forms between the sides 32 the part 13 a recessed storage compartment for spare blades.

Figure 3:
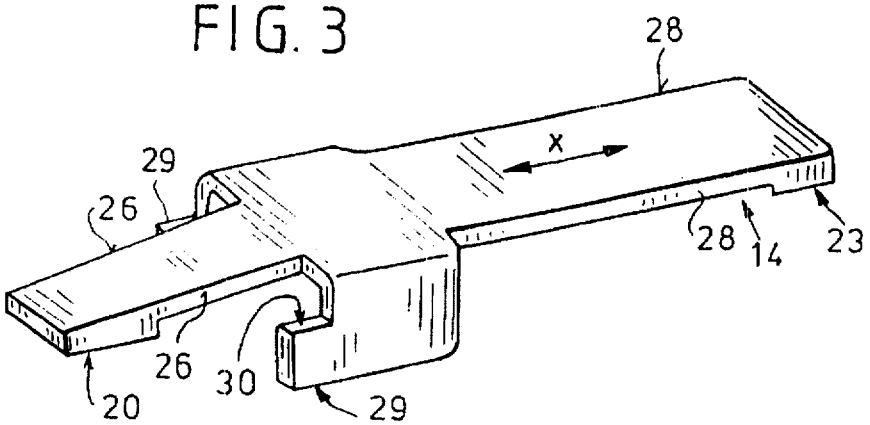
Figure 4:
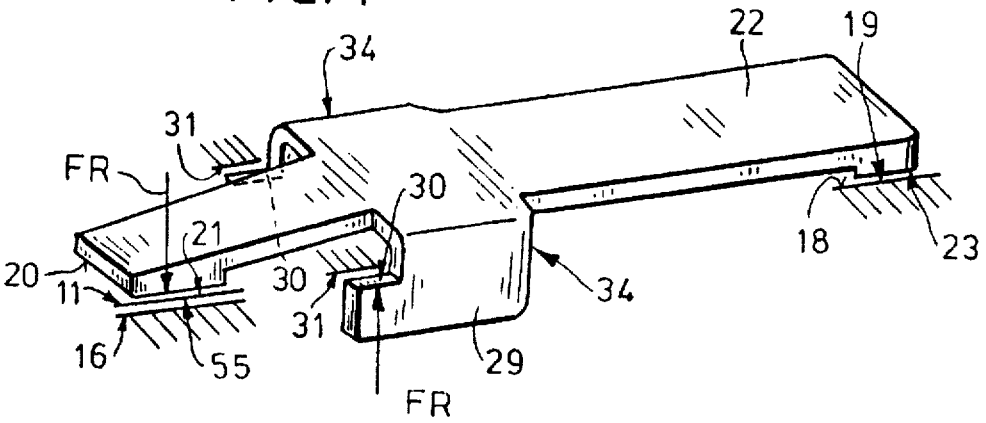
FIG. 4 is a largely diagrammatic perspective view of the cover and the adjacent surfaces.

The cover 14 as best shown in FIGS. 3 and 4 has a rear end 22 formed with a downwardly directed planar surface 23 that normally rides flatly on the surface 19 and a front end with a downwardly directed surface 20 that normally rides on the back face 21 of the blade 11, pressing its lower face 55 down against the surface 16. The rear end 22 has side surfaces 28 that extend parallel to each other and that normally ride on the guide surfaces 27 of the base 13 and the front end similarly has surfaces 26 that extend parallel to each other and that normally ride on the guide surfaces 25 of the base 13. In addition the cover 14 has a pair of depending arms 34 that are able to fit in the notches 33 between the guides 17 and 32 and that are basically L-shaped, each with a forward projection 29 having an upwardly directed surface 30 that can engage under the surface 31 of the respective guide 17.

Figure 5:
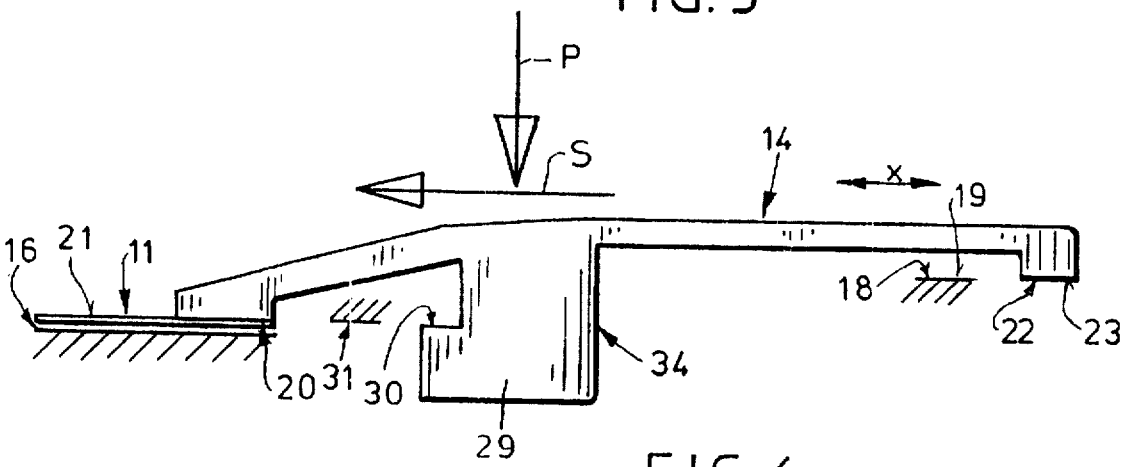
FIG. 5 is a diagrammatic side view of the cover and the adjacent surfaces.
Figure 6:
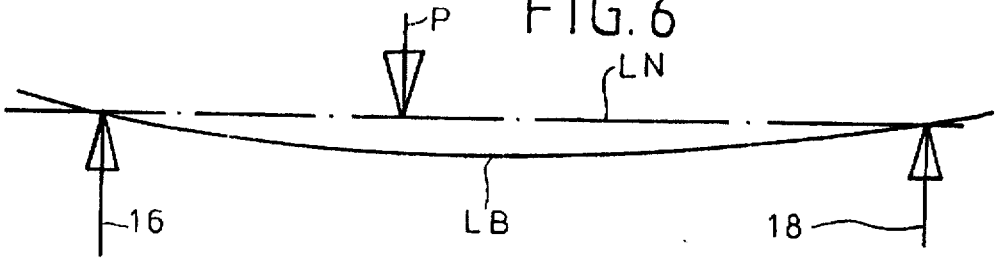
FIG. 6 is a diagram illustrating the forces in the system of this invention.
Figure 7:
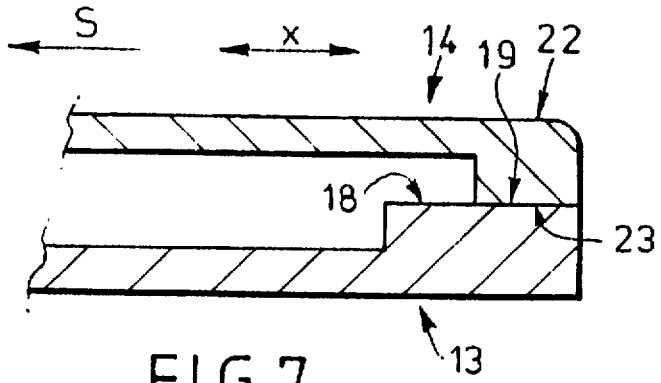
FIG. 7 is a large-scale vertical section through the rear end of the knife.

The surfaces 16, 20, 19, 23, 30, and 31 are all planar and parallel to each other as illustrated in FIG. 5, and some of them may even be coplanar. Nonetheless the spacing of their planes perpendicular to themselves is such that the cover 14 needs to be deformed transversely somewhat so that it can be moved forward in direction S from the rear position illustrated in FIG. 5 to the forward position of FIGS. 1 and 4. In other words it is necessary to exert a transverse force P (FIG. 5) sufficient to displace the surface 30 below the surface 31 to make this move, bending the longitudinal centerline of the part 14 as shown in FIG. 6 from a straight line LN to a bent line LB.

As result, when a blade 11 is laid on the surface 16, the cover 14 can be fitted to the base 13 and then pushed down and slid forward, locking the cover 14 in place by elastic deformation while solidly pinching the blade 11 between the surfaces 16 and 20.

Figure 8:
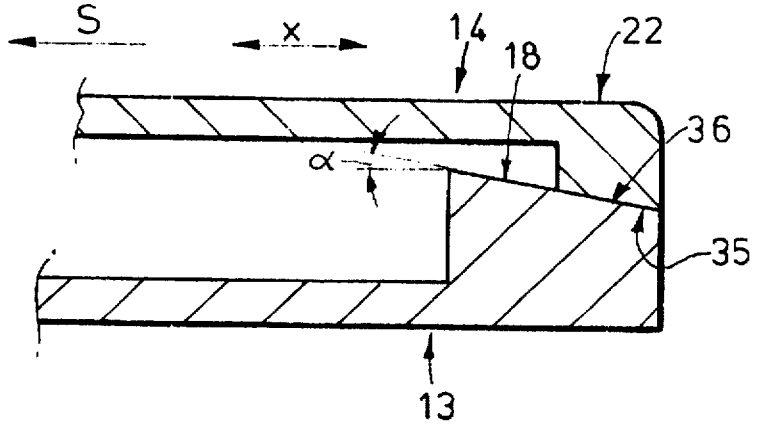
FIGS. 8 and 9 are views like FIG. 7 showing alternative structures according to the invention.

FIG. 8 shows how, unlike the system of FIGS. 1 through 7, the surfaces 19 and 23 can be replaced by surfaces 35 and 36 extending at a small acute angle $\alpha$ to the longitudinal direction x. This interfit ensures that as the cover 14 is moved forward from the illustrated rear position, it is deformed more for a very tight hold.

Figure 9:
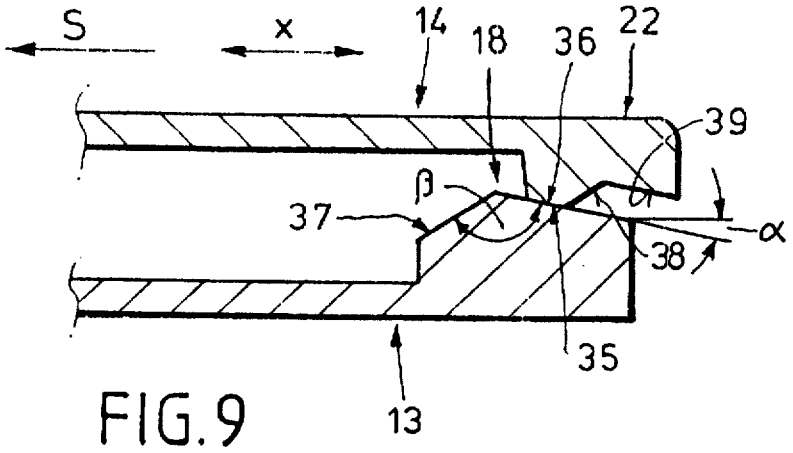

In FIG. 9 the front edge of the support 18 is formed with an upwardly and forwardly directed beveled surface 37 extending at a large obtuse angle $\beta$ to the surface 36, and a front portion of the rear end 22 of the part 14 projects downward and forms a complementary rearwardly directed surface 38 and another surface 39 parallel to the surface 36. When this cover 14 is pushed fully forward, the surface 38 slides down on the surface 37, with the two surfaces 37 and 38 and the two surfaces 36 and 39 fitting complementarily together, and the system is locked in the front position.

Figure 10:
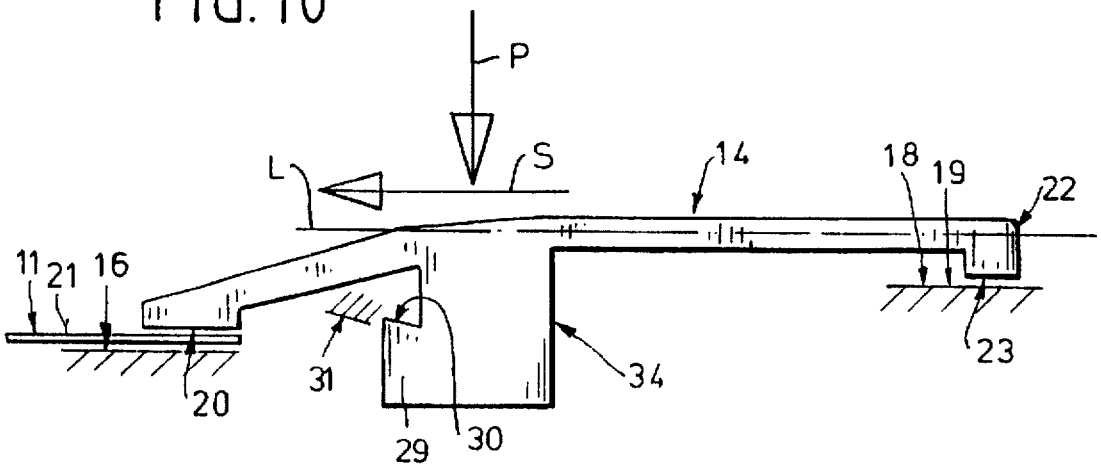
FIGS. 10, 11, and 11A are schematic side views of further variations on the instant invention.

FIG. 10 shows an arrangement where the middle surfaces 30 and 31 are both angled to the longitudinal, in planes each forming a rearwardly open small angle with the longitudinal axis L. This system also holds in the front position.

Figure 11A:
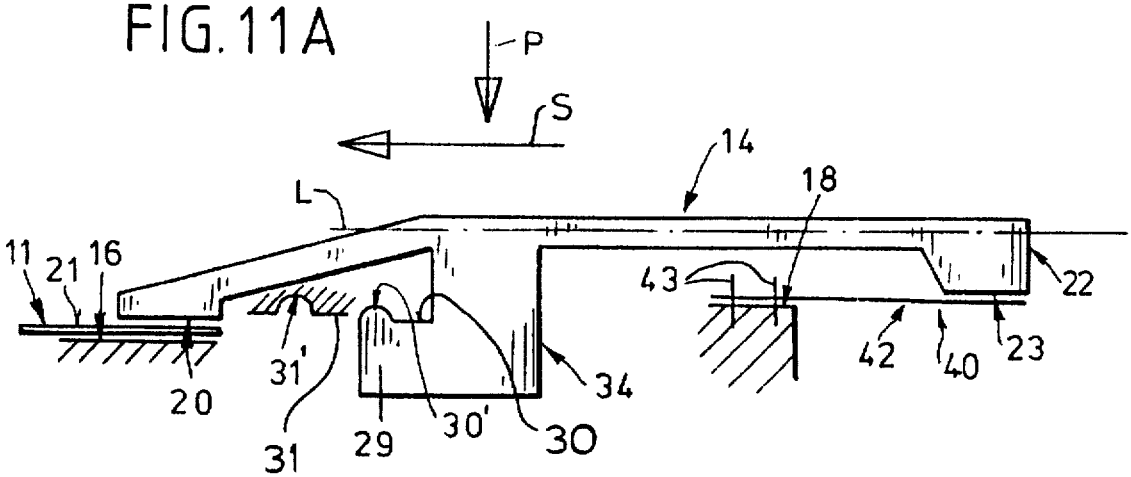

In FIG. 11A the surface 30 is formed with an upwardly directed bump 30' and the surface 31 with a downwardly directed cavity 31' into which this bump 30' can fit. Thus in the front position the formations 30' and 31' interfit and hold the assembly together. In addition here the surface 18 is replaced by a spring 40 extending parallel to the longitudinal centerline L backward from the support 18, to which it is secured by screws 43. The surface 23 slides on a free end 42 of the spring 40.

Figure 11:
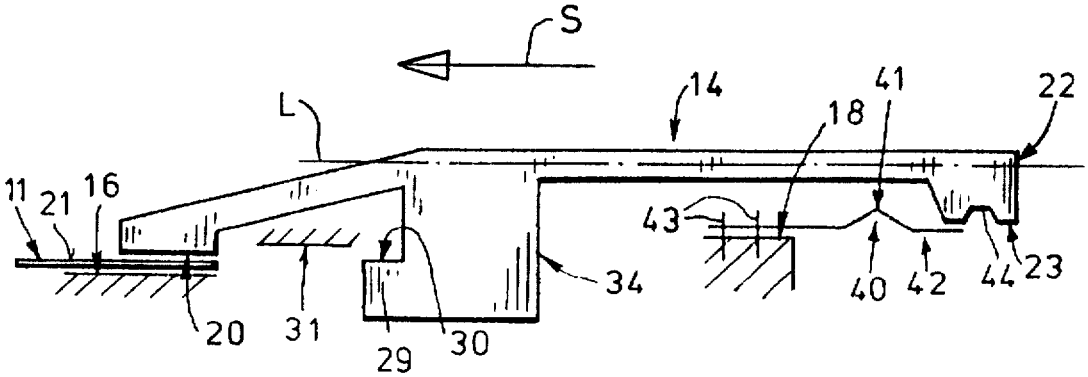
Figure 12:
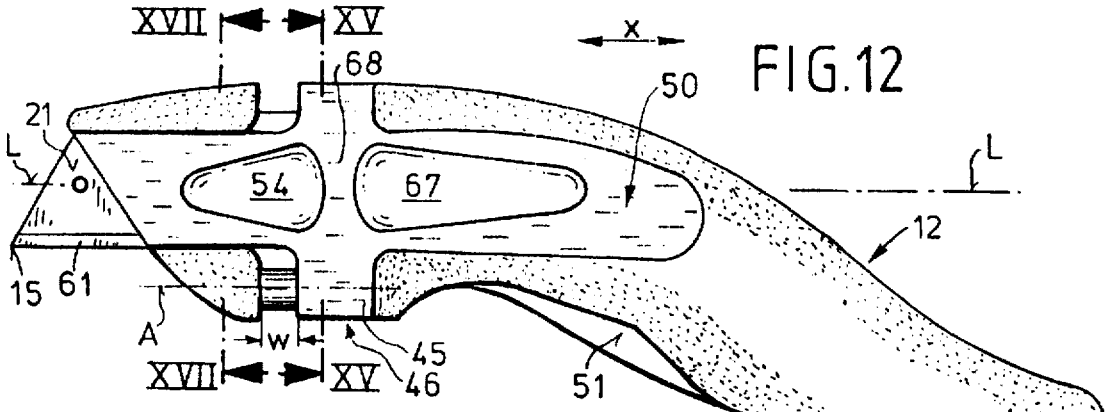
FIGS. 12, 13, and 14 are side views of another knife according to the invention in the rear, front, and pivoted-out positions of the cover.
Figure 13:
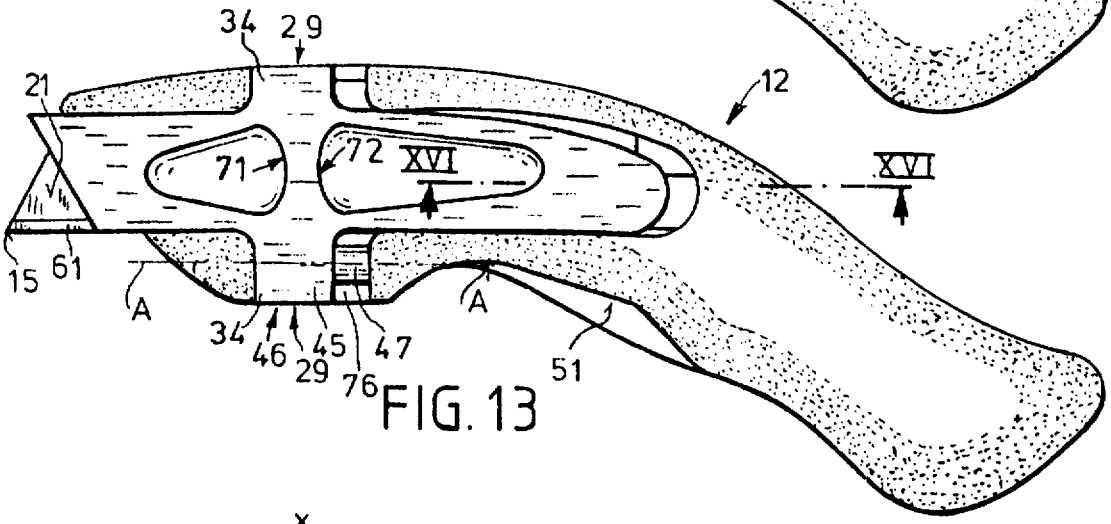

In the system of FIG. 11 the spring free end 42 is formed with an upwardly directed projection or bend 41 that can fit into a downwardly open recess 44 cut in the surface 23. Thus the spring 40 can be deflected down as the slidable cover 14 is moved forward in direction S, but will snap up into and hold in the recess 44 in the front position.

FIGS. 12 through 17 show another arrangement where reference numerals from FIGS. 1 through 11 are used for functionally if not physically identical structure. Here one of the depending arms 34 is formed as a hinge eye 45 constituting with a pin 47 set in the part 14 a hinge 46 having a pivot axis A. As shown in FIG. 15 the pin 47 is held between a pair of outwardly deflectable arms 48 and 49 of the part 14 but is set solidly in or actually unitarily formed with the cast aluminum of the part 14.

The part 14 has a rearwardly projecting end 50 that can engage in a pivoted-out front position an abutment rib 51 formed on the part 13. In addition that arm 34 opposite the arm 34 forming the hinge 46 is formed with a short claw 52 and there-adjacent with a cutout 73 so that it can engage through a notch 53 cut in the side abutment 17, with the claw 52 forming the surface 30 and the guide 17 the surface 31. The overall longitudinal dimensions of the arms 34 in the direction x are substantially smaller by a distance w than the width of the notches 33 to allow them to move axially therein. In addition the cover part 14 is formed with a front grip recess 54 and a back grip recess 67 separated by a stiffening web 68 having forwardly and rearwardly facing edges 71 and 72 so that the part 14 can easily be pushed back and forth in the direction x by the thumb of a user whose fingers are wrapped around the body 12. A hole 75 gives access to an interior of a handle portion 74 of the part 13 and a filler piece 76 partially surrounding the pin 47 prevents the cover 14 from being slid back when swung out as in FIG. 14.

Figure 14:
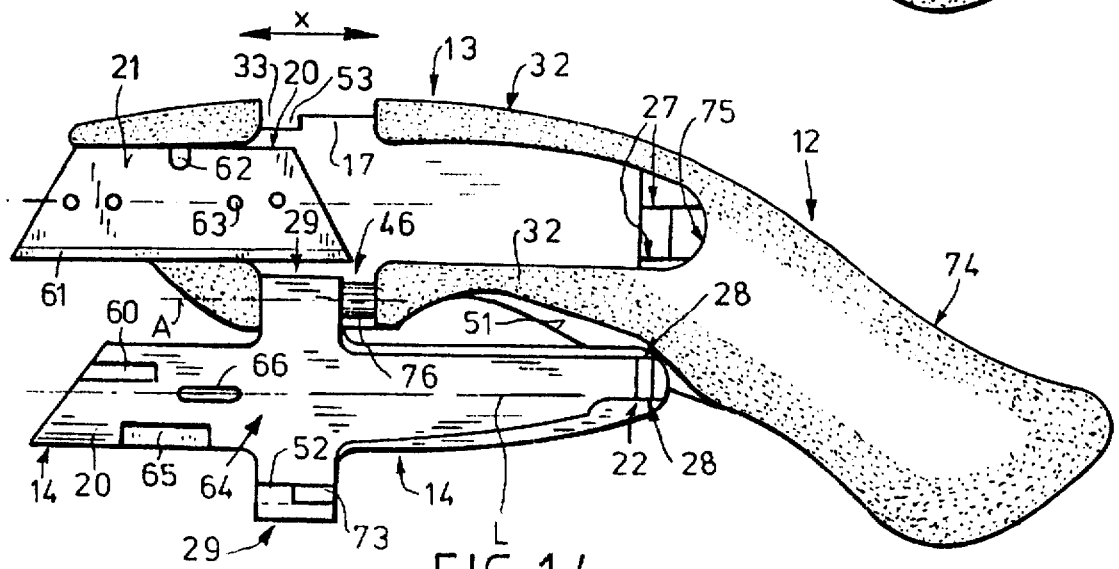

FIG. 17 shows how the surface 16 is formed along its longitudinal edges with ridges or raised portions 56 and 57 forming edges 58 and 59 that engage the face 55 of the blade 11. The part 14 is formed projecting from its inner face 64 with a central longitudinally projecting ridge 60. Thus when the blade is compressed between the parts 13 and 14 it is bowed about a longitudinal axis parallel to its cutting edge 61 to stiffen it. Furthermore as shown in FIG. 14 the surface 16 is formed with pins 62 and 63 that align with and project through corresponding holes in the blade 11 and the part 14 is formed with grooves 65 and 66 in which the outer ends of these pins 62 and 63 can engage to effectively trap the blade 11 and prevent it from slipping longitudinally.

In FIG. 16 the part 13 has a projection 69 provided with a hard-metal pin 70 forming the surfaces 36 and 37 for the rear end 22 of the part 14. This prevents the softer metal of the part 13 from being worn excessively.

Figure 18:
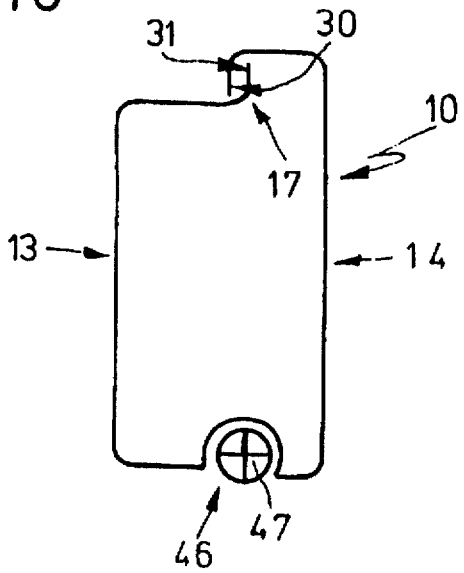
FIGS. 18 and 19 are schematic end views illustrating further variations on the inventive system.
Figure 19:
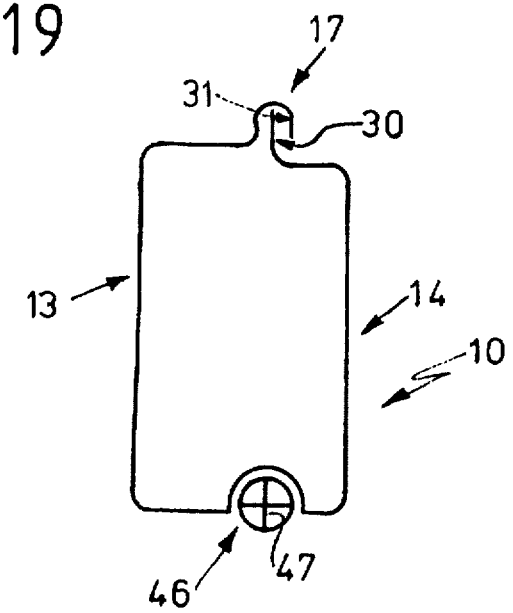

FIGS. 18 and 19 show how the surfaces 30 and 31 can be arranged oppositely, either with one facing in and the other facing out (FIG. 18) or with the one engaged over the other and facing out and the other in (FIG. 19).

I claim:

1. A utility knife for use with a flat blade having a pair of opposite faces, the knife comprising:

an elongated base part formed with an outwardly directed rear support surface, an outwardly directed front support surface separated longitudinally therefrom, and an inwardly directed intermediate surface between the support surfaces, the blade normally lying on the front support surface and projecting longitudinally forward past the base part;

an elongated cover part having an inwardly directed rear surface normally riding on the base-part rear support surface, an inwardly directed front surface normally pressing the blade inward against the base-part front support surface, and an outwardly directed intermediate surface, the cover part being displaceable longitudinally between one longitudinal end position with the intermediate surfaces confronting each other and another longitudinal end position with the intermediate surfaces out of transverse alignment with each other; and means including a biasing formation on at least one of the parts for in the one longitudinal end position urging the cover-part intermediate surface transversely outward with a spring force into engagement with the base-part intermediate surface and thereby pressing the front and rear cover-part surfaces toward the respective front and rear base-part surfaces.

2. The utility knife defined in claim 1 wherein the formation is an elastically flexible body of the cover part.

3. The utility knife defined in claim 1 wherein the formation is a spring element mounted on the base part and transversely bearing on the cover part.

4. The utility knife defined in claim 1, further comprising means including holding formations on the parts for releasably retaining the cover part in the one longitudinal end position on the base part.

5. The utility knife defined in claim 4 wherein the holding formations include a transversely projecting bump on one of the intermediate surfaces and a transversely oppositely open recess on the other intermediate surface complementarily engageable with the bump in the one longitudinal end position.

6. The utility knife defined in claim 4 wherein the base part includes a spring element mounted on the base part, transversely bearing on the cover part, forming the biasing formation, and formed with the holding formations.

7. The utility knife defined in claim 6 wherein the spring element is formed with a bump constituting one of the holding formations, the cover part being formed with a recess complementarily engageable with the bump and forming another of the holding formations.

8. The utility knife defined in claim 1 wherein the rear surfaces are both substantially planar and parallel to a longitudinal axis of the cover part.

9. The utility knife defined in claim 1 wherein the rear surfaces are both substantially planar and form a small forwardly open acute angle with a longitudinal axis of the cover part.

10. The utility knife defined in claim 1 wherein one of the rear surfaces is formed with a transverse projection extending toward the other of the rear surfaces and the other of the rear surfaces is formed with a cutout fitting complementary with the projection in the one longitudinal end position.

11. The utility knife defined in claim 1 wherein the cover part is formed with a pair of inwardly projecting arms that flank the base part and are each formed with a respective such outwardly directed intermediate surface, the base part having a pair of guides each juxtaposed with a respective one of the arms and each formed with a respective such inwardly directed intermediate surface.

12. The utility knife defined in claim 11 wherein the base part is formed with a pair of lateral notches in each of which a respective one of the arms is limitedly longitudinally displaceable.

13. The utility knife defined in claim 12 wherein the base part is provided with a longitudinally extending pin in one of the notches and the respective arm is wrapped around the pin and forms therewith a slide-joint and hinge, the cover part being pivotal about the pin on the base part in at least the one longitudinal end position.

14. The utility knife defined in claim 1 wherein the base-part front surface is formed with a pair of ridges transversely spaced to support only longitudinal edges of the blade, the cover part being formed with a middle ridge engageable between the base-part ridges with the blade, whereby the blade is bent between the ridges.

15. The utility knife defined in claim 14 wherein the blade has a longitudinal cutting edge and an opposite back edge and the middle ridge is closer to the cutting edge than to the back edge.

16. The utility knife defined in claim 1 wherein the front support surface is formed with at least one short outwardly projecting pin engaged through a hole in the blade.

17. The utility knife defined in claim 16 wherein the cover part is formed with a longitudinally extending slot in which the pin engages.

18. The utility knife defined in claim 1 wherein the cover part is formed with a front thumb recess having a back edge and a rear thumb recess having a front edge.

19. The utility knife defined in claim 18 wherein the cover part is formed between the recesses with a full-strength web.

20. The utility knife defined in claim 1 wherein the base part is made unitarily of cast aluminum.

* * * * *